US005503760A

United States Patent [19]

Bongardt et al.

[11] Patent Number: 5,503,760

[45] Date of Patent: Apr. 2, 1996

[54] ENGINE BASE OILS WITH IMPROVED SEAL COMPATIBILITY

[75] Inventors: Frank Bongardt, Duesseldorf; Karl-Heinz Schmid, Mettmann, both of Germany

[73] Assignee: Henkel Kommanditgesellschaft auf Aktien, Duesseldorf, Germany

[21] Appl. No.: 331,534

[22] PCT Filed: Apr. 24, 1993

[86] PCT No.: PCT/EP93/00993

§ 371 Date: Nov. 2, 1994

§ 102(e) Date: Nov. 2, 1994

[87] PCT Pub. No.: WO93/22407

PCT Pub. Date: Nov. 11, 1993

[30] Foreign Application Priority Data

May 2, 1992 [DE] Germany ..... 42 14 653.4

[51] Int. Cl.[6] ..... C10M 105/38; C10M 105/18

[52] U.S. Cl. ..... 252/52 R; 252/56 S

[58] Field of Search ..... 252/56 S, 56 R, 252/52 R

[56] References Cited

U.S. PATENT DOCUMENTS

| | | | |
|---|---|---|---|
| 3,655,559 | 4/1972 | Holt | 252/56 S |
| 3,694,382 | 9/1972 | Kleiman et al. | 252/56 S |
| 3,871,837 | 3/1975 | Bedague et al. | 252/56 S |
| 3,957,667 | 5/1976 | Tanizaki et al. | 252/73 |
| 4,025,447 | 5/1977 | Mancini et al. | 252/56 S |
| 4,049,563 | 9/1977 | Burrous | 262/56 S |
| 4,061,581 | 12/1977 | Lely et al. | 252/56 S |
| 4,115,282 | 9/1978 | Grasshoff | 252/22 |
| 4,144,183 | 3/1979 | Koch et al. | 252/56 S |
| 4,175,045 | 11/1979 | Tomony | 252/56 S |
| 4,234,497 | 11/1980 | Honig | 252/56 S |
| 4,304,678 | 12/1981 | Schick et al. | 252/56 S |
| 4,317,780 | 3/1982 | Mancini et al. | 252/56 S |
| 4,374,282 | 2/1983 | Maldonado et al. | 252/52 R |
| 4,440,660 | 4/1984 | van Rijs et al. | 252/56 S |
| 4,481,123 | 11/1984 | Hentschel et al. | 252/52 R |
| 4,968,453 | 11/1990 | Wada et al. | 252/56 S |
| 5,057,247 | 10/1991 | Schmid et al. | 252/56 S |

FOREIGN PATENT DOCUMENTS

| | | |
|---|---|---|
| 0523560 | 1/1993 | European Pat. Off. . |
| 2295121 | 7/1976 | France . |
| 2467186 | 4/1981 | France . |

*Primary Examiner*—Margaret Medley
*Attorney, Agent, or Firm*—Wayne C. Jaeschke; John E. Drach; Henry E. Millson, Jr.

[57] ABSTRACT

A process is disclosed for producing motor base oils with an improved gasket compatibility. Also disclosed are motor oils containing carboxylic acid ester and ether as base oils.

12 Claims, No Drawings

ENGINE BASE OILS WITH IMPROVED SEAL COMPATIBILITY

BACKGROUND OF THE INVENTION

1. Field of the Invention

This invention relates to a process for the production of engine base oils with improved seal compatibility and to engine oils containing carboxylic acid esters and ethers as base oils.

2. Statement of Related Art

Engine oils contain base oils to ensure satisfactory lubrication at high temperatures, effective sealing between piston and cylinder and smooth starting of the engine at low outside temperatures. Known base oils based on mineral oil and also synthetic components, such as poly-α-olefins and esters, can guarantee satisfactory lubrication. In addition, engine oils or rather their base oils should show neutral behavior towards engine seals in order to prevent unwanted leakage of the engine oil into the engine compartment, for example through shrinkage of the seals. For this reason, polyolefins for example, which unfortunately shrink seals, are combined with esters which are known to lead to swelling in contact with elastomers. With environmental considerations in mind, however, efforts are being made to provide engine oils which show better biodegradability. For this reason, it would be desirable to replace non-readily biodegradable base oils, such as poly-α-olefins or mineral oils, in engine oils. However, the readily biodegradable esters lead to swelling of the seals which places an unnecessary burden on the seals. Accordingly, there is a need to provide engine base oils which show both better biodegradability than mineral oils and polyolefins and also improved seal compatibility.

It has now surprisingly been found that the requirements stated above are satisfied by engine base oils based on carboxylic acid esters to which ethers have been added.

DE-A-30 38 996 describes thermally stable semisynthetic lubricants of mineral oils and polyol ethers which are obtained by condensation of alcohols, such as pentaerythritol, trimethylol alkanes and/or neopentyl glycol, with alkyl halides.

EP-A-286 141 describes lubricants based on mineral and/or synthetic oil which additionally contain at least one compound bearing at least one quaternary carbon atom and at least one ester and/or ether bond in the molecule. Lubricants such as these are said to have improved load-bearing, lubricating and corrosion-inhibiting properties. Ester and ether compounds mentioned as suitable are those of monopentaerythritol, dipentaerythritol and adamantane derivatives. However, highly branched ether compounds such as these are not readily biodegradable. In addition, there is nothing in this document to indicate that mixtures of the type in question also have improved seal compatibility.

DESCRIPTION OF THE INVENTION

Accordingly, the present invention relates to a process for improving the seal compatibility of engine base oils based on carboxylic acid esters, characterized in that ethers of alcohols containing 1 to 6 hydroxyl groups are added.

The ethers added in accordance with the invention may be monoethers, diethers and polyethers. To enable them to be added to the base oil, the ethers should either be liquid at room temperature (20° C.) or should form a mixture liquid at room temperature with the carboxylic acid esters. Of the ethers listed in the following, those which are themselves liquid are particularly preferred.

The monoethers are derived from monohydric aliphatic alcohols containing 6 to 36 carbon atoms which may be linear or branched. Linear saturated alcohols containing 8 to 12 carbon atoms and/or branched saturated alcohols containing 6 to 24 carbon atoms are preferred because the monoethers derived therefrom have particularly high flash points. Examples of suitable linear alcohols are caprylic alcohol, pelargonic alcohol, capric alcohol, undecanol alcohol, lauryl alcohol and/or the technical mixtures thereof accumulating after the hydrogenation of fatty acid mixtures of natural fats and/or oils. Among the branched alcohols, both lightly branched alcohols, which are branched solely by methyl groups, and highly branched alcohols, such as the so-called Guerbet alcohols formed by the Guerbet process, may be used. Suitable Guerbet alcohols are, for example, 2-hexyl decanol, 2-hexyl decanol, 2-octyl decanol and/or 2-octyl dodecanol. Among the monoethers, those derived from linear alcohols, such as di-n-octyl ether, di-n-decyl ether and octyldecyl ether, are most particularly preferred for the purposes of the invention.

Diethers prepared by etherification of diols with monohydric alcohols may also be added in accordance with the present invention. Preferred diethers are those derived from diols with 4 to 10 carbon atoms and etherified with monohydric aliphatic alcohols containing 6 to 36 carbon atoms. Examples of suitable diols are 1,6-hexanediol, 1,7-heptanediol, 1,8-octanediol and/or 1,10-decanediol. Examples of suitable monohydric aliphatic alcohols and preferred representatives thereof can be found in the preceding paragraph.

In addition, polyethers derived from branched polyols containing 3 to 6 hydroxyl groups may be added in accordance with the invention. Of these polyols, those containing a quaternary carbon atom are preferred. Trimethylol propane, pentaerythritol and/or dipentaerythritol are particularly suitable. These polyols are etherified with monohydric aliphatic alcohols containing 6 to 36 carbon atoms which have already been described in the preceding paragraph. Of these polyethers, trimethylol propane triethers of linear saturated alcohols containing 8 to 12 carbon atoms, such as n-octanol, n-decanol and/or n-dodecanol, are particularly preferred.

Of all the various ethers, monoethers derived from aliphatic saturated alcohols containing 8 to 12 carbon atoms are most particularly preferred for the purposes of the invention.

Suitable carboxylic acid esters are any known carboxylic acid esters. Dicarboxylic acid diesters of monohydric alcohols and/or full esters of polyhydric alcohols with monocarboxylic acids are preferred. Among the dicarboxylic acid diesters, those derived from α,ω-dicarboxylic acids containing 4 to 10 carbon atoms, preferably from adipic, pimelic, suberic, azelaic and/or sebacic acid, are recommended. Suitable monohydric alcohols are, again, the monohydric aliphatic alcohols of the type described above and, in this case, particularly the branched monohydric aliphatic alcohols containing 6 to 36 carbon atoms and preferably saturated types containing 6 to 24 carbon atoms. Outstanding dicarboxylic acid diesters are the adipic acid diesters of lightly branched alcohols containing 6 to 24 carbon atoms, such as adipic acid diesters of isononanol, isodecanol, isotridecanol and/or isohexadecanol, and also the adipic and azelaic acid diesters of Guerbet alcohols, such as di-2-hexyldecyl azelaic acid ester.

Full esters of polyhydric alcohols with monocarboxylic acids may be present instead of or in admixture with the dicarboxylic acid diesters. Preferred full esters are esters of branched polyhydric alcohols containing a quaternary carbon atom selected from the group consisting of trimethylol propane, pentaerythritol and/or dipentaerythritol. These alcohols are preferably esterified with monocarboxylic acids containing 6 to 22 carbon atoms. The monocarboxylic acids are best aliphatic monocarboxylic acids which are preferably saturated. Suitable representatives of these esters are trimethylol propane tricapryl ester, trimethylol propane tricaprinyl ester, trimethylol propane trilauryl ester and/or mixtures thereof.

When the described ethers are added to the engine base oil, an improvement in seal compatibility, particularly with rubber seals, is observed without any significant deterioration in the lubricating properties of the engine base oil. To achieve a distinct improvement in seal compatibility, it is best to add the ethers in quantities of at least 10% by weight, based on base oil. The ethers are preferably added in quantities of at most 90% by weight, based on base oil. The balance to 100% by weight of the base oils are carboxylic acid esters of the described type.

The present invention also relates to engine oils with improved seal compatibility containing as base oil carboxylic acid esters and monoethers of monohydric aliphatic alcohols containing 6 to 36 carbon atoms and/or diethers and/or trimethylol propane ethers of monohydric aliphatic alcohols containing 6 to 36 carbon atoms.

Particulars of the individual ester and ether compounds can be found in the foregoing text.

The quantity of ethers and carboxylic acid esters as base oil in the engine oil depends to a large extent on the requirements the engine oil is expected to satisfy. In general, it is useful if the engine oil contains the base oil in quantities of 50 to 99% by weight and additives in quantities of 1 to 50% by weight. Typical additives are oxidation inhibitors, such as sulfur and/or phosphorus compounds, phenol derivatives and amines, viscosity index improvers, such as polyisobutenes, polymethacrylates, diene polymers and polyalkyl styrenes, pour point depressants, such as metal soaps, carboxylic acids, polymethacrylates, alkylphenols and phthalic acid dialkylaryl esters, heavy duty (HD) additives, such as naphthenates, stearates, sulfonates, phenolates, salicylates, phosphates, phosphorates, carbonates, methacrylate copolymers and fumarates, extreme pressure (EP) additives, such as sulfur, chlorine and/or phosphorus compounds, friction reducers, antifoam agents and corrosion inhibitors.

EXAMPLES

A) Preparation of the ethers

Example 1) Di-n-octyl Ether 206 kg (1581.8 moles) of n-octanol were heated to 190°–210° C. together with 2.94 kg of sulfosuccinic acid (70% by weight). The water of reaction formed was distilled off. After 7 hours, 10.3 g of 50% by weight sodium hydroxide were added to the cooled reaction mixture for neutralization, after which the crude product was washed until neutral and then distilled.

Example 2) Trimethylol Propane Tridecyl Ether 187.6 g of trimethylol propane (1.4 moles) were heated to 80° C. with 1680 g of 50% by weight sodium hydroxide. 742.2 g of decyl chloride (4.2 moles) and 124.6 g of tetrabutylammonium chloride were then added. After 5 hours, the crude product was washed until neutral and dried.

B) Engine base oils

Engine base oils (E) with the following composition were produced:

E 1 90% by weight $C_8/C_{10}$ TMP 10% by weight di-n-octyl ether of Example 1

E 2 50% by weight $C_8/C_{10}$ TMP 50% by weight di-n-octyl ether of Example 1

E 3 10% by weight $C_8/C_{10}$ TMP 90% by weight di-n-octyl ether of Example 1

E 4 50% by weight $C_8/C_{10}$ TMP 50% by weight TMP tridecyl ether of Example 2

E 5 90% by weight diisotridecyl adipate 10% by weight di-n-octyl ether of Example 1

E 6 50% by weight diisotridecyl adipate 50% by weight di-n-octyl ether of Example 1

E 7 10% by weight diisotridecyl adipate 90% by weight di-n-octyl ether of Example 1

C1 100% by weight $C_8/C_{10}$ TMP $C_8/C_{10}$ TMP=trimethylol propane triester of a 53.8% by weight $C_8$ and 45.5% by weight $C_{10}$ fatty acid mixture, rest impurities; characteristic data: acid value AV (DIN 53240) 0.1, hydroxyl value HV (DIN 53240) 2.3, saponification value SV (DIN 53401) 303, iodine value IV (DGF-C-V 116) 0.1.

Diisotridecyl adipate; characteristic data: AV 0.03, IV 0.5, SV 220, OHV 5.

To test seal compatibility, swelling tests were carried out on SRE-NBR-1 seals and Shore A hardness was determined in accordance with DIN 53538.

In the swelling test, 162.8 ml of engine base oils E 1 to C 1 was poured into a vessel and the SRE-NBR-1 seal weighed beforehand was placed therein. The vessel was closed and stored for 168 hours at 100° C. The sealing ring was then removed, wiped dry and reweighed.

The weight differences in % and the Shore A hardnesses before and after the swelling test are set out in Table 1 for the engine base oils.

TABLE 1

| Engine base oil | Swelling test; Shore A hardness: % Weight difference | Shore A hardness swelling: before | Shore A hardness swelling: after | Shore A hardness difference |
|---|---|---|---|---|
| E1 | 18.43 | 83 | 78 | 5 |
| E2 | 12.8 | 82 | 75 | 7 |
| E3 | 8.74 | 83 | 77 | 6 |
| E4 | 15.8 | 83 | 76 | 7 |
| E5 | 14.96 | 83 | 76 | 7 |
| E6 | 11.53 | 84 | 79 | 5 |
| E7 | 8.55 | 82 | 82 | 0 |
| C1 | 19.7 | 82 | 72 | 10 |

It can be seen from Table 1 that engine base oils E 1 to E 7 all show a smaller weight difference than C 1, i.e. they cause less swelling of the sealing ring. Accordingly, the rings treated with the engine base oils are not as soft (Shore A hardness) as the ring treated with the comparison oil.

What is claimed is:

1. In a process for improving the seal compatibility of a carboxylic acid ester-based engine base oil selected from the group consisting of a di-monohydric alcohol ester of a dicarboxylic acid, a mono-carboxylic acid ester of a polyol, and mixtures thereof, the improvement wherein a seal compatibility improving quantity of at least one ether selected from the group consisting of:

a) a monoether derived from a linear or branched monohydric aliphatic alcohol containing from 6 to 36 carbon atoms, b) a diether which is the reaction product of the etherification of a diol having from 4 to about 10 carbon atoms with a monohydric alcohol containing from 6 to 36 carbon atoms, and c) a polyether which is the reaction product of the etherification of trimethylolpropane, pentaerythritol, or dipentaerythritol with a monohydric aliphatic alcohol containing from 6 to 36 carbon atoms is added to said engine base oil.

2. The process of claim 1 wherein said ether is a derivative of a monohydric alcohol having a linear alkyl group comprised of from 8 to about 12 carbon atoms.

3. The process of claim 1 wherein said ether is a derivative of a monohydric alcohol having a branched alkyl group comprised of from 6 to about 24 carbon atoms.

4. The process of claim 1 wherein said ester is a di-$C_{6-36}$ branched alkyl monohydric alcohol ester of a $C_{4-10}$ dicarboxylic acid.

5. The process of claim 1 wherein said ester is a $C_{6-22}$ monocarboxylic acid ester of a branched polyol selected from the group consisting of trimethylol propane, pentaerythritol, dipentaerythritol, and mixtures thereof.

6. The process of claim 1 wherein the amount of said ether added to said carboxylic acid ester-based engine base oil is at least about 10% by weight.

7. A carboxylic acid ester-based engine base oil composition comprising

A) a carboxylic acid ester-based engine base oil selected from the group consisting of a di-monohydric alcohol ester of a dicarboxyylic acid, a mono-carboxylic acid ester of a polyol, and mixtures thereof; and B) a compatibility improving quantity of at least one ether selected from the group consisting of:

a) a monoether derived from a linear or branched monohydric aliphatic alcohol containing from 6 to 36 carbon atoms, b) a diether which is the reaction product of the etherification of a diol with a monohydric alcohol containing from 6 to 36 carbon atoms, and c) a polyether which is the reaction product of the etherification of trimethylolpropane, pentaerythritol, or dipentaerythritol with a monohydric aliphatic alcohol containing from 6 to 36 carbon atoms.

8. The composition of claim 7 wherein said ether is a derivative of a monohydric alcohol having a linear alkyl group comprised of from 8 to about 12 carbon atoms.

9. The composition of claim 7 wherein said ether is a derivative of a monohydric alcohol having a branched alkyl group comprised of from 6 to about 24 carbon atoms.

10. The composition of claim 7 wherein said ester is a di-$C_{6-36}$ branched alkyl monohydric alcohol ester of a $C_{4-10}$ dicarboxylic acid.

11. The composition of claim 7 wherein said ester is a $C_{6-22}$ monocarboxylic acid ester of a branched polyol selected from the group consisting of trimethylol propane, pentaerythritol, dipentaerythritol, and mixtures thereof.

12. The composition of claim 7 wherein the amount of said ether in the composition is at least about 10% by weight.

* * * * *